United States Patent [19]

Bartok

[11] 4,382,459

[45] May 10, 1983

[54] WOOD SPLITTING MAUL

[76] Inventor: Joseph Bartok, 2930 Highway 1131, Vidor, Tex. 77662

[21] Appl. No.: 291,189

[22] Filed: Aug. 10, 1981

[51] Int. Cl.[3] ..... B26B 23/00; B27L 7/00

[52] U.S. Cl. ..... 145/2 R; 144/193 D; 254/104

[58] Field of Search ..... D8/47, 76; 145/2 R; 144/193 D; 254/104

[56] References Cited

U.S. PATENT DOCUMENTS 1,499,560 7/1924 Stangeland ..... 254/104

FOREIGN PATENT DOCUMENTS 738881 6/1980 U.S.S.R. ..... 144/193 D

*Primary Examiner*—W. D. Bray

*Attorney, Agent, or Firm*—Cahill, Sutton & Thomas

[57] ABSTRACT

A wood splitting maul includes a maul head having two inclined blade faces that meet to form a sharpened blade edge. A plurality of elongated, cylindrical roller bearing elements are rotatably disposed in respective recesses in each of the blade faces and extend outwardly from the blade faces to force the walls of a split being formed in a log to move away from a portion of the blade faces, reducing friction between the walls of the split and the blade faces.

9 Claims, 4 Drawing Figures

WOOD SPLITTING MAUL

BACKGROUND OF THE INVENTION

The invention relates to wood splitting mauls, particularly those with means for reducing friction between a maul head and a log in which a split is being formed by the maul.

Various devices are known for splitting logs, including splitting wedges, such as the one disclosed in U.S. Pat. No. 4,194,544, that are driven into a short length log by repeated blows from a sledge hammer, mechanized log splitting devices such as those disclosed in U.S. Pat. Nos. 3,038,510 and 3,670,789, and various axe or maul heads with ridges, grooves, wedges, and lever arms as shown in U.S. Pat. No. De. 26,335 and U.S. Pat. Nos. 246,566; 561,000; and 4,044,808, respectively. The splitting device shown in Pat. No. 4,044,808 is an unduly complex device that is more expensive and less reliable than is desirable, and does not function satisfactorily for logs which are exceptionally "tough" and difficult to split. The device shown in U.S. Pat. No. De. 26,335 does not significantly reduce friction between the blade faces and the split being formed in the log. This is also the case for the devices shown in U.S. Pat. Nos. 561,000 and 246,566. Furthermore, if any of the known prior splitting devices becomes lodged in a log because the log fails to split completely apart, it is frequently quite difficult to remove the prior maul heads from the log because of a high level of friction between the walls of the split and the opposed blade faces of the maul head.

Accordingly, it is an object of the invention to provide an improved wood splitting maul that is inexpensive, highly reliable and substantially reduces friction between the blade faces of the maul and a log through which the maul is being driven in order to form a split in the log.

SUMMARY OF THE INVENTION

Briefly described, and in accordance with one embodiment thereof, the invention provides a wood splitting maul including a maul head having first and second opposed inclined blade faces that meet to form a sharpened blade edge, and having bearing elements rotatably disposed in recesses in the opposed blade faces of the maul head. The bearing elements extend outwardly from the blade faces and engage the walls of a split being formed in the log to push the walls of the split away from the blade faces, thereby reducing friction between the walls of the split and the blade faces. In the described embodiment of the invention, a plurality of elongated, semi-cylindrical recesses are formed in each of the blade faces. Cylindrical, elongated roller bearings are rotatably disposed in each of the recesses, each of the roller bearings extending beyong the blade face surface. Each of the roller bearings is supported on an axel that extends into portions of the maul head adjacent to the ends of the respective semi-cylindrical recesses. In one embodiment of the invention, a handle is attached to the maul head. In another embodiment of the invention, the maul head is attached to a powered mechanism.

DESCRIPTION OF THE INVENTION

Figure 1:
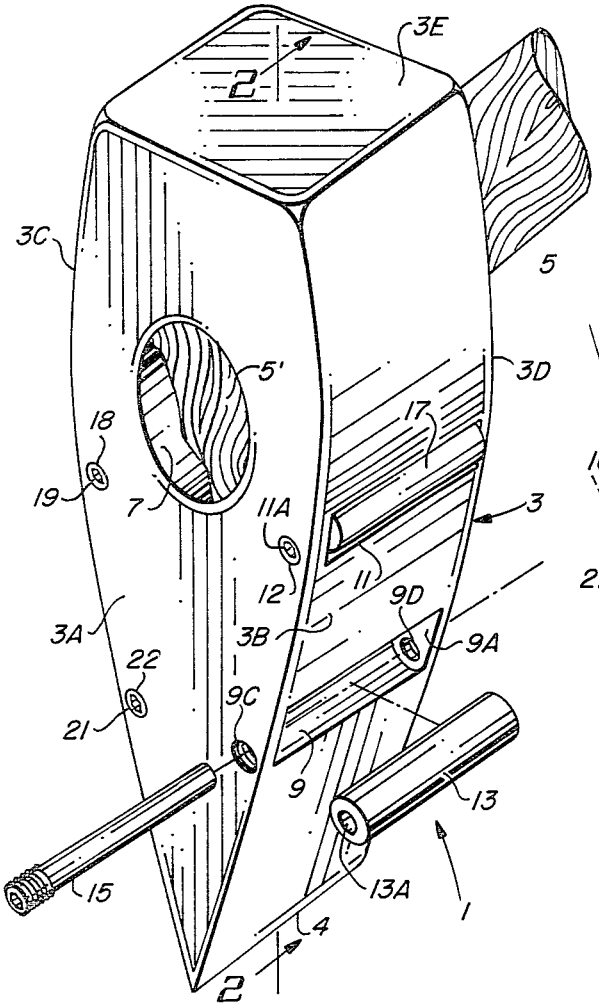
FIG. 1 is a perspective, partially exploded view of the wood splitting maul of the present invention.
Figure 2:
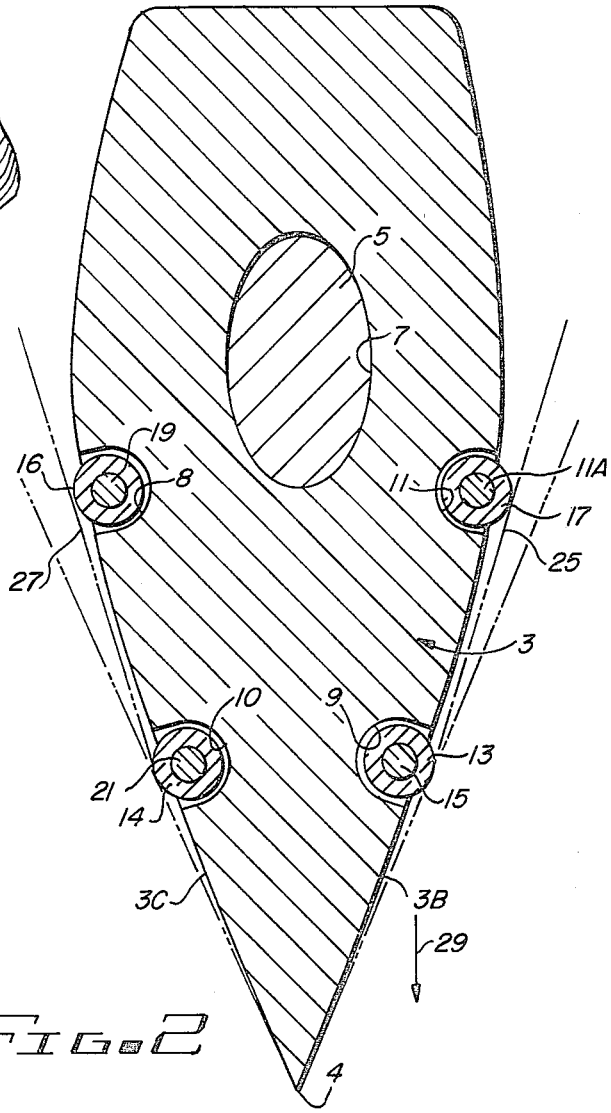
FIG. 2 is a section view taken along section line 2—2 of FIG. 1.
Figure 3:
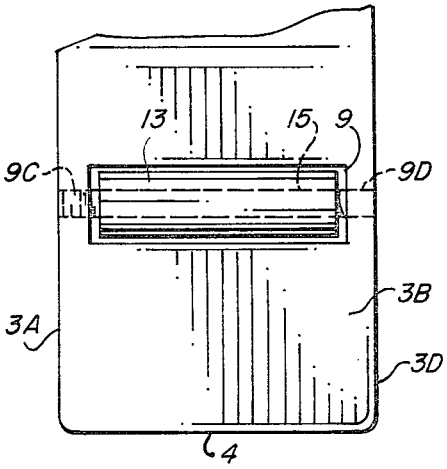
FIG. 3 is a partial side view of the wood splitting maul of FIG. 1.

Referring now to the drawings, particularly FIGS. 1-3 wood splitting maul 1 includes a maul head 3 and a handle 5 that extends through handle receiving hole 7 in maul head 3. Reference numeral 5' denotes one end of handle 5.

Maul head 3 includes a lower sharpened blade edge 4 that is formed by the joining of two opposed blade faces 3B and 3C of maul head 3. The lower portions of blade faces 3B and 3C are inclined outwardly from blade edge 4 to the upper thickened portion of maul head 3. The upper portion of blade faces 3B and 3C curve inwardly somewhat as they extend to upper surface 3E of maul head 3. The plane of upper surface 3E is approximately parallel to an axis of handle 5, as is blade edge 4.

Maul head 3 also is bounded by opposed faces 3A and 3D, which are approximately parallel in the disclosed embodiment of the invention. However, the lower pointed portions of faces 3A and 3D could be flared outward to increase the length of blade edge 4.

What has been described with reference to the drawings up to this point is the structure of a conventional wood splitting maul. In accordance with the present invention, elongated, semi-cylindrical recesses 9 and 11 are provided in the inclined portion of blade face 3B. Similarly, elongated semi-cylindrical recesses 8 and 10 are disposed in the lower inclined portion of blade face 3C, as shown in FIG. 2. Roller bearing 13 is rotatably disposed in recess 9 by means of axel 15, which extends through axial opening 13A in roller bearing 13. The extreme ends of axel 15 extend into holes 9C and 9D in end walls 3A and 3D, respectively. The diameter and placement of roller bearing 13 is such that a portion of its surface extends outwardly roughly one sixteenth to one fourth of an inch beyond blade face 3B. (The diameter and placement of the other roller bearings disclosed are similar.)

Similarly, a roller bearing 17 is rotatably disposed in recess 11 by means of an axel 12 that extends through an axial hole in roller bearing 17 and is supported in holes such as 11A. Roller bearings 14 and 16 are rotatably disposed in and supported in recesses 10 and 8, respectively, by means of axels 19 and 21. The ends of axels 19 and 21 are supported in holes such as 18 and 22, respectively. As best seen in FIG. 2, each of roller bearings 14, 16 and 17 extends beyond the adjacent blade faces.

The means of implementing the axels, such as axel 15, and retaining them in holes such as 9C and 9D can be implemented in a variety of ways. For example, a solid axel with threaded end portions that are screwed into holes 9C and 9D could be provided. A shoulder could be provided on shaft 15 to prevent it from being screwed too far into hole 9D to effect tightening of axel 15 as the shoulder engages the semi-circular wall 9A that forms the rear end of semi-cylindrical recess 9 in FIG. 1. A screwdriver slot or a hex-shaped opening for receiving an Allan Wrench could be provided in one or both ends of axel 15 to effect tightening of the axel. Those skilled in the art will recognize that various other axel and axel support devices also could be readily used.

In FIG. 2, dotted lines 25 and 27 denote the walls of a split being formed in a log through which maul head 3 is being forced in the direction indicated by arrow 29. Leading blade edge 4 first enters the surface of the log, beginning the split. As maul head 3 moves further into the log, the walls of the split frictionally engage the lower portions of inclined blade faces 3C and 3B, resulting in considerable friction. When the maul head 3 is sufficiently deep (roughly one to one and three-fourths of an inch) into the log that the walls of the split engage lower roller bearings 13 and 14, roller bearings 13 and 14 begin to roll, and, since they extend outwardly beyond blade faces 3B and 3C, the walls 25 and 27 of the split are pushed outwardly away from the lower surface portions of blade faces 3B and 3C. This greatly reduces frictional contact between the walls of the split and blade faces 3B and 3C, allowing maul head 3 to more easily move deeper into the log.

As the split in the log widens, the lower portions of the walls of the split may move away from blade edge 4, and the upper portions of the walls of the split may move inwardly toward blade faces 3B and 3C. If this happens, the walls of the split may engage upper roller bearings 16 and 17, which prevent the friction that would otherwise exist between the adjacent portions of blade faces 3B and 3C in the respective walls 25 and 27 of the split in the log. In some instances, it may be desirable to provide additional recesses and roller bearings in blade faces 3B and 3C, although for most purposes, provision of two roller bearings in each blade face is adequate.

Although the roller bearings are substantially parallel to blade edge 4, they could be inclined relative to blade edge 4. Furthermore, in some instances, other types of protruding bearings, such as ball bearings or substantially shortened roller bearings, might be advantageously utilized.

Figure 4:
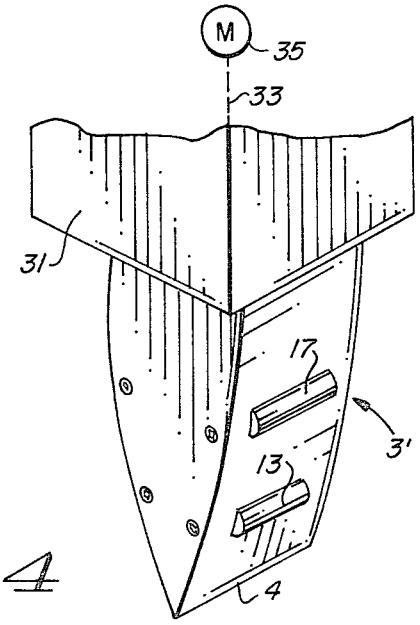
FIG. 4 is a partial perspective view of an alternate embodiment of the invention.

Referring now to FIG. 4, handle 5 has been eliminated. Reference numeral 3′ designates a maul head without a handle receiving hole. Maul head 3′ is very similar to maul head 3 of FIG. 1, except that instead of having a handle attached thereto, it is rigidly attached to a driving member designated by reference numeral 31. Dotted line 33 represents a mechanical coupling of driver member 31 to a power source schematically represented by reference numeral 35. Power source 35 can be any suitable mechanical power source, such as a hydraulic cylinder that mechanically forces the leading edge 4 of maul head 3′ into a log to split it. Roller bearings 13 and 17 function in the same manner previously explained.

Not only do the above-described roller bearings reduce the friction between the walls of the wood split and the blade faces of the maul head as it is being forced into the log, the roller bearings greatly reduce the amount of effort required to remove the maul head from the split or crack in the log if the log is not completely split in half by the initial penetration of the maul head. Users of maul heads will know that frictional force between the walls of a crack or split in a "stubborn log" is often sufficiently great to make it very difficult to remove a maul head. The above-described embodiment of the invention largely overcomes this problem.

While the invention has been described with reference to several specific embodiments thereof, those skilled in the art will be able to make various obvious modifications to the disclosed embodiment of the invention without departing from the true spirit and scope thereof.

I claim:

1. A maul for splitting wood, said maul comprising in combination:

(a) a maul head having first and second opposed inclined blade faces that each meet at one end to form a sharpened blade edge, said first blade face having therein a first bearing receiving recess and a second blade face therein, a second bearing receiving recess;

(b) first bearing means rotatably disposed in said first bearing receiving recess for engaging a first surface of a split in a log through which said maul head moves and forcing the first surface of the split outward from said first blade face to reduce friction between said first blade face and the first surface of the split; and (c) second bearing means rotatably disposed in said second bearing receiving recess for engaging a second surface of the split and forcing the second surface of the split outward from said second blade face to reduce friction between said second blade face and the second surface of the split.

2. The maul of claim 1 including a handle, said maul head having a hole for receiving said handle.

3. The maul of claim 1 wherein said first and second bearing receiving recesses are elongated, semi-cylindrical recesses having opposed semi-circular end walls each having an axel-receiving opening therein.

4. The maul of claim 3 wherein said first and second bearing means include first and second elongated, cylindrical rollers, disposed, respectively, in said first and second semi-cylindrical recesses.

5. The maul of claim 4 including first and second axel means for rotatably supporting said first and second rollers in said first and second semi-cylindrical recesses, respectively.

6. The maul of claim 5 wherein each of said first and second axel means has end portions extending from the opposed ends of said first and second rollers into respective corresponding ones of said holes in said semi-circular end walls.

7. The maul of claim 6 wherein said first and second rollers are substantially parallel to said blade edge.

8. The maul of claim 7 wherein said first and second rollers each extend sufficiently far outwardly of said first and second blade faces to force first and second walls of the split sufficiently far from adjacent portions of said first and second blade faces, respectively, to substantially reduce friction between first and second walls of the split and said first and second blade walls, respectively.

9. The maul of claim 1 including two blade receiving recesses and two bearing means rotatably disposed therein, respectively, in each of said first and second blade faces.

* * * * *